US008245999B2

(12) United States Patent
Tartan et al.

(10) Patent No.: US 8,245,999 B2
(45) Date of Patent: Aug. 21, 2012

(54) STACKING APPARATUS

(75) Inventors: Adlihan Tartan, Istanbul (TR); Egemen Kose, Istanbul (TR)

(73) Assignee: Arcelik A.S., Istanbul (TR)

( * ) Notice: Subject to any disclaimer, the term of this patent is extended or adjusted under 35 U.S.C. 154(b) by 936 days.

(21) Appl. No.: 11/914,733

(22) PCT Filed: May 18, 2006

(86) PCT No.: PCT/IB2006/051573

§ 371 (c)(1),
(2), (4) Date: Jun. 25, 2008

(87) PCT Pub. No.: WO2006/123303

PCT Pub. Date: Nov. 23, 2006

(65) Prior Publication Data

US 2008/0308709 A1 Dec. 18, 2008

(30) Foreign Application Priority Data

May 18, 2005 (TR) ..... a 2005 01868

(51) Int. Cl.
*F16M 11/00* (2006.01)

(52) U.S. Cl. ..... 248/678; 248/687; 68/3 R; 211/59.4

(58) Field of Classification Search ..... 248/670, 248/687, 672, 673, 678, 682, 345.1; 68/3 R; 312/107; 206/585, 509; 211/59.4, 51.3
See application file for complete search history.

(56) References Cited

U.S. PATENT DOCUMENTS

| | | | | |
|---|---|---|---|---|
| 2,843,889 | A * | 7/1958 | Keller | 52/312 |
| 3,103,422 | A * | 9/1963 | Green | 34/238 |
| 3,108,393 | A * | 10/1963 | Baker | 248/345.1 |
| 3,779,624 | A * | 12/1973 | Werderitsch | 312/278 |
| 4,846,435 | A * | 7/1989 | Cohen | 248/346.01 |
| 5,040,760 | A * | 8/1991 | Singer | 248/284.1 |
| 5,496,609 | A * | 3/1996 | Michelstein | 428/71 |
| 5,653,416 | A * | 8/1997 | Frank | 248/682 |
| 6,840,591 | B2 * | 1/2005 | Wessel | 312/278 |
| 7,685,846 | B2 * | 3/2010 | Hwang et al. | 68/3 R |
| 7,685,848 | B2 * | 3/2010 | Jeong et al. | 68/3 R |

FOREIGN PATENT DOCUMENTS

GB 2221970 A * 2/1990

* cited by examiner

*Primary Examiner* — Korie Chan
(74) *Attorney, Agent, or Firm* — Venable, Campillo, Logan & Meaney PC

(57) ABSTRACT

The present invention relates to a stacking apparatus (1) enabling two front-loaded household appliances (X, Y) to be stacked. The stacking apparatus (1) of the present invention comprises an elastic bumper (4) that covers the gap left in between the household appliances.

8 Claims, 3 Drawing Sheets

[Fig. 0001]
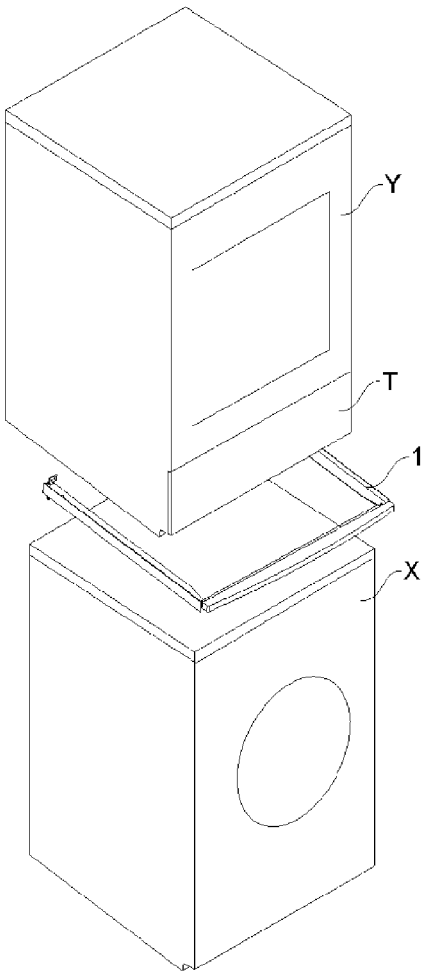
[Fig. 0002]
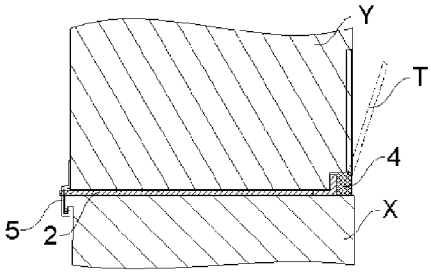
[Fig. 0003]
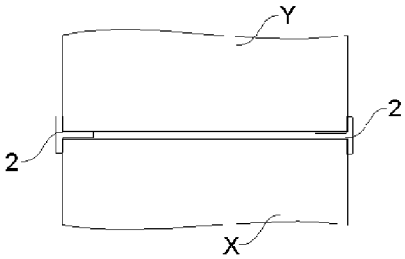
[Fig. 0004]
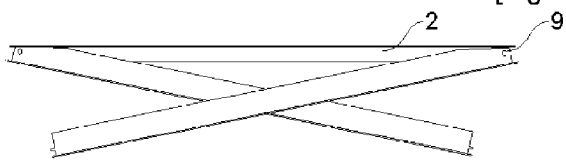

[Fig. 0005]
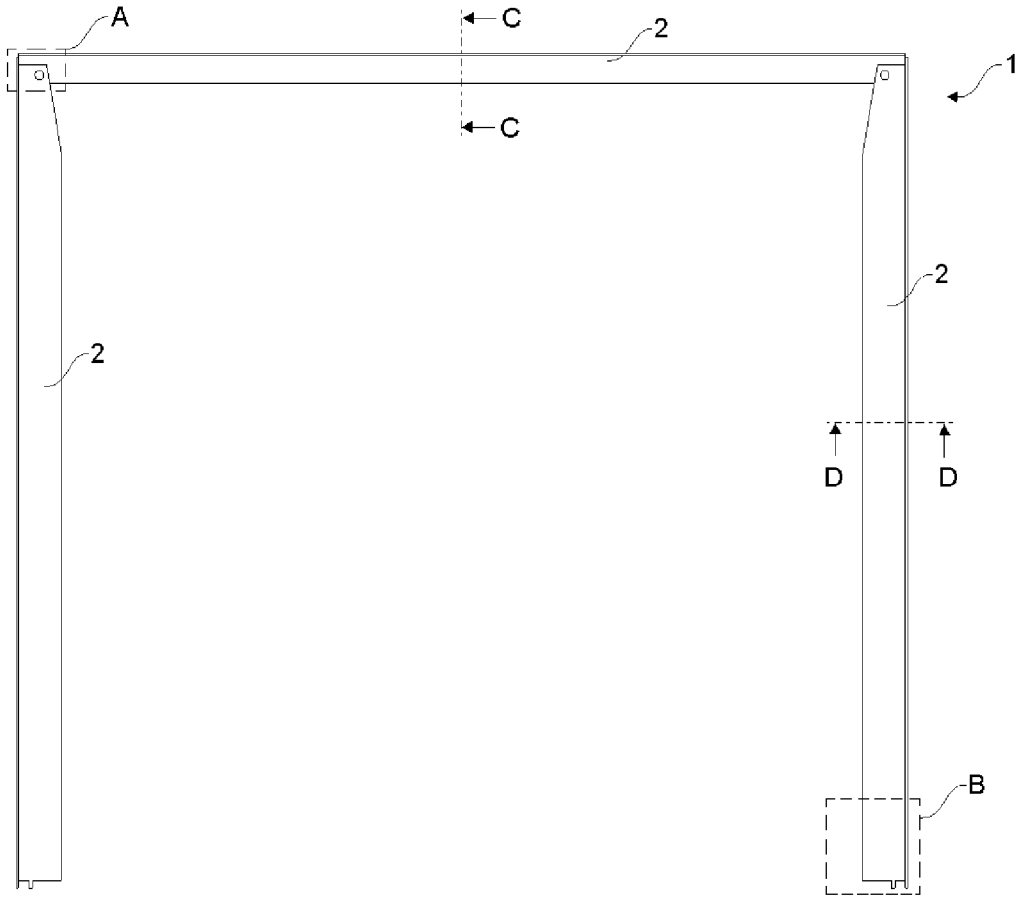
[Fig. 0006]
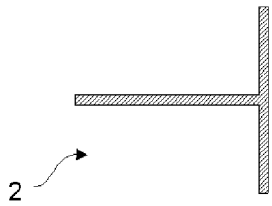
[Fig. 0007]
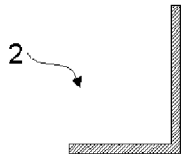
[Fig. 0008]
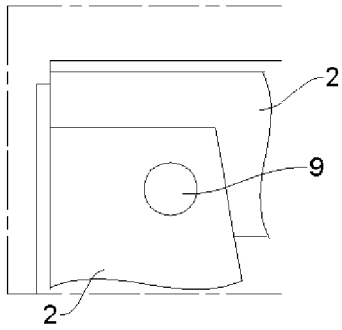

[Fig. 0009]
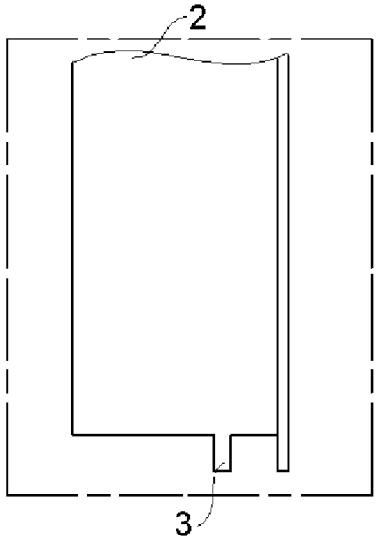
[Fig. 0010]
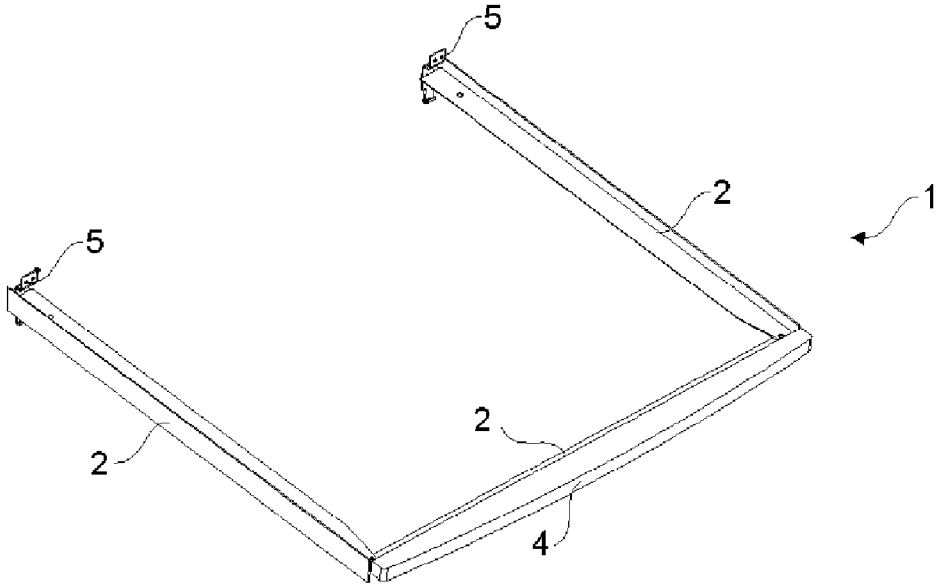
[Fig. 0011]
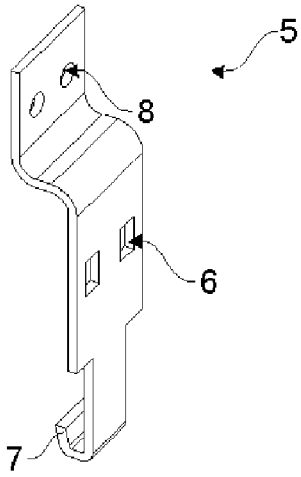

STACKING APPARATUS

FIELD OF THE INVENTION

The present invention relates to a stacking apparatus that enables placing two household appliances on top of each other.

BACKGROUND

The household appliances, especially the front-loaded ones such as washers and dryers are stacked on top of the other during exhibition and usage due to limited usable space in the shops and homes. Household appliances forming a long column are attached to each other with a stacking apparatus to prevent toppling.

In the British Patent no. GB817788, a description is given of a washer, a dryer superposed invertedly on top of the washer and an apparatus joining both, comprising a strip-shaped intermediary member.

In the German Patent no. DE3827790, an element for mounting an upper appliance e.g. a laundry drier, on a lower appliance, e.g. a laundry washing machine is described. This element comprises Z-shaped brackets fixed with screws to the top surface of the lower appliance and three side panels covering the gap between the two appliances. The kick-plate of the dryer is taken out when mounting it on top of the washing machine.

The French Patent no. FR2672962, describes a device for superposing household appliances such as refrigerators on top of each other, comprising three panels attached by screws to the appliance at the bottom that have holes for the feet of the appliance on the top.

The assembly of the devices used in the state of the art is laborious since they comprise separate parts or panels attached to each other and the household appliances by means of screws, detents and the like.

Furthermore, a gap has to be left between the stacked household appliances to be able to open their kick-plate covers. This results in accumulation of dust, grime and such between the household appliances. Furthermore an unaesthetic appearance is formed.

SUMMARY

The object of the present invention is to design a stacking apparatus that enables easy attachment of two stacked household appliances without leaving a gap in between.

The stacking apparatus designed to fulfill the objectives of the present invention is described in the claim 1.

This apparatus comprises a bumper unlike other conventional state of the art applications. This bumper completely fills the gap left between the stacked household appliances in order to open the kick-plate cover of the appliance at the top or for other reasons when the kick-plate cover is closed, and when the kick-plate is desired to be opened, the bumper allows it by being deformed. The material features of the bumper allow it to resume its former shape closing the gap again after the cover is closed.

The other features of the present invention are explicated in the dependent claims.

The bumper is painted the same color as the household appliances so that the stacked appliances can be perceived as a single unit, helping in achieving an esthetic appearance. Furthermore, the front surface of the bumper is formed in a similar fashion as the front surface of the household appliance which further enhances the effect in the unity of perception.

The bumper is also furnished with a self-adhesive surface which enables it to be easily assembled to the household appliance or to other conventional state-of-the-art stacking devices without utilizing any other tools. This self-adhesive surface is covered by a protective band to keep the dust away, safeguarding the adhesion feature.

With the stacking apparatus of the present invention, the gap left between the household appliances when they are stacked is fully covered without the need for displacing and/or changing the kick-plate cover.

BRIEF DESCRIPTION OF THE DRAWINGS

The stacking apparatus designed to fulfill the object of the present invention is shown in the attached figures, where:

FIG. 1—is the perspective view of the stacking apparatus and two household appliances before they are assembled to each other.

FIG. 2—is the side sectional view of the stacking apparatus and two household appliances after they are assembled to each other.

FIG. 3—is the rear schematic view of the stacking apparatus and two household appliances after they are assembled to each other.

FIG. 4—is the top view of the folded profiles.

FIG. 5—is the top view of a stacking apparatus.

FIG. 6—is the D-D sectional view of a profile.

FIG. 7—is the C-C sectional view of a profile.

FIG. 8—is the view of Detail A of a stacking apparatus.

FIG. 9—is the view of Detail B of a stacking apparatus.

FIG. 10—is the perspective view of a stacking apparatus.

FIG. 11—is the perspective view of a bracket.

DETAILED DESCRIPTION

Elements shown in figures are numbered as follows:

1. Stacking apparatus
2. Profile
3. Detent
4. Bumper
5. Bracket
6. Recess
7. Bend
8. Hole
9. Hinge The stacking apparatus (1) is utilized in attaching two household appliances (X,Y) to be stacked on one another. The household appliance at the bottom (X) is e.g. a washer, and the one at the top (Y) is e.g. a dryer (FIG. 1). The washer (X) and the dryer (Y) each comprise a top plate and height adjustable feet. Furthermore there is a kick-plate cover (T) at the front bottom side of the dryer (Y) for accessing the parts inside the body such as filter. When the two household appliances are superimposed, the feet of the household appliance at the top (Y) are seated on the top plate of the one at the bottom; leaving a gap between the two household appliances (X, Y) as high as the height of the feet of the household appliance (Y) at the top (FIG. 1, FIG. 2, FIG. 3).

The stacking apparatus (1) of the present invention comprises at least one profile (2) situated between the two superposed household appliances (X, Y) and at least one elastic bumper (4) positioned between the two household appliances (X, Y) so as to cover the gap between them, wherein the bumper is compressed when the movable parts of the household appliances (X, Y) like the kick-plate cover (T) are opened, and resuming its former shape afterwards. The bumper (4) completely covers the gap between the household appliances (X, Y) and also allows opening of the parts that overlap it by being compressed by means of the force applied by these parts (FIG. 2).

In one embodiment of the present invention, the bumper (4) is attached to the household appliances (X, Y) so that it does not fall off.

In another embodiment of the present invention, the bumper (4) is attached to the profile (2) so that it does not fall off (FIG. 2).

In yet another embodiment of the present invention, the bumper (4) has a self-adhesive surface for ease of assembly, thus being able to be affixed to the profile (2) or the household appliances (X, Y) from this surface. During transport, the self-adhesive surface is safeguarded with a band (not shown in the figures).

In another embodiment of the present invention, the bumper (4) is produced of polystyrene foam for the purpose of retaining its elastic feature, withstanding multiple openings of the movable parts during the lifetime of the household appliance (X, Y). In this embodiment, the bumper (4) is painted the same color as the household appliances (X, Y) to maintain a visual unity. This paint is preferably of hydrophobic material.

In the preferred embodiment of the present invention, three aluminum profiles (3) assembled in a U shape are utilized (FIG. 5 and FIG. 10). The profiles (2) positioned facing each other on the opposite sides are T-shaped (FIG. 6). The horizontal portion of the T shape rests on the top plate of the household appliance (X) at the bottom. The other portion extends out from the top plate and contacts externally the side surfaces of both household appliances (X, Y) (FIG. 3). The middle profile (2) is preferably L shaped and joins the two profiles (2) on the opposite sides, being parallel to the front edge of the top plate of the bottom household appliance (X), and a little inwards from this edge (FIG. 2 and FIG. 7). The bumper (4) is affixed to the exterior of the middle profile (2).

In the preferred embodiment of the present invention, the stacking apparatus (1) comprises at least two hinges (9) to join the ends of the profiles (2) so that they can be turned inwards, thus being kept folded when not in use without being displaced from each other and taking up less space (FIG. 4). Preferably, the hinge is in the form of a rivet (FIG. 8).

In another embodiment of the present invention, the stacking apparatus (1) preferably comprises two brackets (5) for connecting the profiles (2) to the household appliances (X, Y) for the purpose of enhancing to secure the balance of the household appliance at the top (FIG. 2 and FIG. 11). The bracket (5) comprises at least one hole (8) enabling it to be fastened to the rear walls of the household appliances (X, Y) by means of screws.

In yet another embodiment of the present invention, the profiles (2) positioned at the sides comprise at least one detent (3) at their free ends that correspond to the rear end of the household appliance (FIG. 9) and the brackets (5) comprise at least one recess (6) into which the detents (3) fit. The profiles (2) can thus be affixed to the household appliances (X, Y) by means of the brackets (5).

In another embodiment of the present invention, the bracket (5) comprises at least one bend (7) allowing it to be fitted in the recesses in the household appliances (X, Y) without screws. This bend (7) is shaped so that it can clasp the top plate of the bottom household appliance (X) from under its rear side (FIG. 2).

The stacking apparatus (1) of the present invention can be folded to be packaged and stored. The profiles (2) are turned around the hinges (9) to be opened and positioned on the top plate of the bottom household appliance (X) at the place of utilization. Then the bumper (4) is adhered to the middle profile (2) after taking the safeguarding band out. Afterwards, the other household appliance (Y) is positioned on top of the former one (X) with the stacking apparatus (1) staying in between. The feet of the top household appliance (Y) stay between the profiles (2). The bumper (4) covers the gap between the two household appliances (X, Y) in the front. The bends (7) of the brackets (5) are fitted under the top plate of the bottom household appliance (X). The detents (3) of the side profiles (2) fit into the recesses (6) in the brackets (5). Finally the bracket (5) is screwed from its holes (8) to the top household appliance (Y). The bumper (4) fills in the gap between the household appliances (X, Y) when the cover (T) is closed, and is compressed by the force applied by the cover (T), allowing the cover (T) to be opened, resuming its former shape after the cover (T) is closed. The stacking apparatus (1) of the present invention covers the gap left in between without preventing the opening of the kick-plate cover (T) of the household appliance at the top (Y) by means of the bumper (4) it comprises, providing the stacking apparatus (1) to be functional and esthetic.

The invention claimed is:

1. A stacking apparatus comprising at least one profile comprising plurality of pieces suitable for being situated between two superposed household appliances (X, Y), and including a bumper having an elastic structure, suitable for being positioned between the household appliances (X, Y) so as to cover gap a left therein, suitable for compressing during the opening of the kick-plate cover (T) or similar movable parts of one of the household appliances, and suitable for later resuming the elastic structure before compressing and further comprising at least one hinge provided to join the pieces of said at least one profile so that they can be turned inwards, thus being kept folded when not in use without being disjointed from each other and taking up less space.

2. The stacking apparatus as in claim 1, wherein the bumper comprises a self-adhesive surface, being affixed to the profile or the household appliance from this surface, and having a band safeguarding the self-adhesive surface during transport.

3. The stacking apparatus as in claim 1 or 2, wherein the bumper attached to the household appliances (X, Y).

4. The stacking apparatus as in claim 1 or 2, wherein the bumper attached to the profile.

5. The stacking apparatus as in claim 1 or 2, wherein the bumper produced of polystyrene foam, painted the same color as the household appliances (X, Y) using a hydrophobic paint.

6. The stacking apparatus as in claim 1 or 2, comprising a bracket for affixing the household appliances (X, Y) to each other.

7. The stacking apparatus as in claim 6, wherein the bracket comprising at least one bend is enabled to be fitted into recesses disposed in the household appliances (X, Y) without screws.

8. The stacking apparatus as in claim 6, wherein the profile further comprises free ends corresponding to the rear end of the household appliances (X, Y) and the free ends having at least one detent and the bracket having recesses into which these detents fit.

* * * * *